US011293282B2

(12) United States Patent
Peter

(10) Patent No.: US 11,293,282 B2
(45) Date of Patent: Apr. 5, 2022

(54) SYSTEM AND METHOD FOR SURFACE TO DOWNHOLE COMMUNICATION WITHOUT FLOW

(71) Applicant: Andreas Peter, Celle (DE)

(72) Inventor: Andreas Peter, Celle (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 115 days.

(21) Appl. No.: 16/881,546

(22) Filed: May 22, 2020

(65) Prior Publication Data

US 2020/0370427 A1 Nov. 26, 2020

Related U.S. Application Data

(60) Provisional application No. 62/851,459, filed on May 22, 2019.

(51) Int. Cl.

| | |
|---|---|
| ***E21B 47/22*** | (2012.01) |
| ***E21B 47/008*** | (2012.01) |
| ***E21B 47/06*** | (2012.01) |
| ***E21B 47/24*** | (2012.01) |

(52) U.S. Cl.

CPC ..... *E21B 47/22* (2020.05); *E21B 47/008* (2020.05); *E21B 47/06* (2013.01); *E21B 47/24* (2020.05)

(58) Field of Classification Search

None

See application file for complete search history.

(56) References Cited

U.S. PATENT DOCUMENTS

| | | | | |
|---|---|---|---|---|
| 4,078,620 | A | 3/1978 | Westlake et al. | |
| 6,909,667 | B2 * | 6/2005 | Shah | E21B 47/18 367/83 |
| 9,617,850 | B2 | 4/2017 | Fripp et al. | |
| 9,702,245 | B1 * | 7/2017 | Dugas | E21B 41/0085 |
| 9,828,853 | B2 * | 11/2017 | Chambers | E21B 34/066 |
| 2015/0226058 | A1 | 8/2015 | Stolpman | |

(Continued)

OTHER PUBLICATIONS

International Search Report and Written Opinion for International Application No. PCT/US2020/034159; International Filing Date May 22, 2020; dated Sep. 1, 2020; 8 Pages.

(Continued)

*Primary Examiner* — Franklin D Balseca

(74) *Attorney, Agent, or Firm* — Cantor Colburn LLP

(57) ABSTRACT

A flow-off telemetry system and method of communicating information from a downhole location in a borehole to a surface location while fluid circulation is off. A string is conveyed in the wellbore to define an inner bore and an annulus. During a flow-off condition, an inner bore sealing element closes the inner bore to create a first standing column of fluid in the inner bore, and an annulus sealing element closes the annulus to form a second standing column of fluid in the annulus. A bypass valve in the string at a downhole location between the first standing column of fluid and the second standing column of fluid is activated to generate a pressure pulse including information for performing an action. The pressure pulse is received at a pressure sensor at the surface location and a controller performs an action in response to the information in the pressure pulse.

20 Claims, 3 Drawing Sheets

(56) References Cited

U.S. PATENT DOCUMENTS

| | | | |
|---|---|---|---|
| 2015/0377018 | A1 | 12/2015 | Lee et al. |
| 2016/0084077 | A1 | 3/2016 | Lehr et al. |
| 2018/0363413 | A1 | 12/2018 | Gao et al. |

OTHER PUBLICATIONS

Salomone, et al.; "Kick Isolation While Drilling—First Field Test of an Innovative Risk MitigationTechnology"; SPE-197756-MS, Abu Dhabi International Petroleum Exhibition & Conference held in Abu Dhabi, UAE, Nov. 11-14, 2019; 8 pages.

* cited by examiner

SYSTEM AND METHOD FOR SURFACE TO DOWNHOLE COMMUNICATION WITHOUT FLOW

CROSS REFERENCE TO RELATED APPLICATIONS

This application claims priority to U.S. Provisional Application Ser. No. 62/851,459, filed on May 22, 2019, the contents of which are incorporated herein in their entirety.

BACKGROUND

The present invention is directed to a method and apparatus for communication in a drill string in a wellbore and, in particular, to a method for communicating in a drill string when no mud flow is flowing in the drill string.

When drilling a wellbore in an earth formation, a drilling mud is extracted from a mud pit at a surface location and circulated downhole through a bore in a drill string to exit at a drill bit at an end of the drill string. Upon exiting the drill string, the drilling mud flows uphole through an annulus between the drill string and the formation to return to the mud pit. Mud pulse telemetry is predicated on the continuous circulation of the drilling mud as described above.

A kick occurs when formation gas or formation fluid enters a wellbore during drilling. In order to control the influx during a kick, the wellbore is usually shut in by closing the annulus and often the bore of the drill string. Closing the wellbore in this manner disrupts the continuous flow of drilling mud and therefore the mud pulse bi-directional telemetry between surface and downhole tools. In some downhole systems, auxiliary telemetry options, such as wired pipe or electromagnetic telemetry, are not available. Therefore, a telemetry system is needed that can communicate information between a downhole location and a surface location without mud flow.

BRIEF DESCRIPTION

Disclosed herein is a method of communication information from a downhole location in a borehole to a surface location while fluid circulation is off. A string of a downhole system is conveyed in the wellbore, the string defining an inner bore and an annulus. A first standing column of fluid is created in the inner bore and a second standing column of fluid is created in the annulus by closing at least one of the inner bore using an inner bore sealing element and the annulus using annulus sealing element during a flow off condition. A bypass valve at a downhole location in the string is activated to generate a pressure pulse due to a pressure difference between the first standing column of fluid and the second standing column of fluid, wherein the generated pulse is communicative of information. The pressure pulse is received at a pressure sensor at the surface location. A controller performs an action in response to the information in the pressure pulse.

Also disclosed herein is a flow-off telemetry system in a wellbore, including a string in a wellbore, the drill string defining an inner bore of the string and an annulus between the string and a wall of the wellbore; at least one of an inner bore sealing element configured to close the inner bore to create a first standing column of fluid in the inner bore and an annulus sealing element configured to close the annulus to form a second standing column of fluid in the annulus; a bypass valve in the string at a downhole location between the first standing column of fluid and the second standing column of fluid, wherein activation of the bypass valve generates a pressure pulse including information for performing an action; a sensor at a surface location receptive to the pressure pulse; and a controller configured to perform an action in response to the information in the pressure pulse.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Drilling operations are beginning to be applied towards deep and ultra-deep water environments, HPHT (high pressure high temperature) conditions, anomalous pressures and reduced margin between pore and fracture gradients regimes. Faced with these challenges, the oil and gas industry is making a concentrated effort to enhance HSE (health safety and environment) performance and operational safety. The primary concern of all parties involved in well operations is to maintain full control of formation fluids (hydrocarbons such as oil, gas or $H_2S$) at all times, preventing their migration from the formation to the external environment. A standard system to prevent formation fluid influx to reach the surface is a Blow out preventer (BOP). In advanced operations, an additional in-hole barrier that can be utilized while operating, such as a Downhole Isolation Packer (DHIP) system, can increase operational safety and well control. Uncertainty in predicting formation integrity as well as pressure regimes poses significant risks to drilling operations. Several technologies can predict downhole environments in terms of formation strength and kick detection. DHIP systems for kick isolation in high risk wells confine the fluid influx from the formation at the well bottom. A DHIP can be integrated in a bottom hole assembly (BHA) or placed somewhere else in a string. A downhole isolation packer isolates on demand a formation from the rest of the wellbore in a kick situation by (i) inflating a packer element to shut-in the annulus, and (ii) closing a string valve to confine the influx at the well bottom below the sealing elements. A DHIP system enables the implementation of safer well control operations by preventing the formation fluid influx from migrating toward the surface during preparations to kill the well. A DHIP can also be a useful downhole tool when drilling challenging formations with high mud loss potential, such as depleted reservoirs, fractured formations and karstified carbonates. By activating a DHIP in a total mud loss situation, the losses can be handled in a controlled manner before developing into a well control situation.

Figure 1:
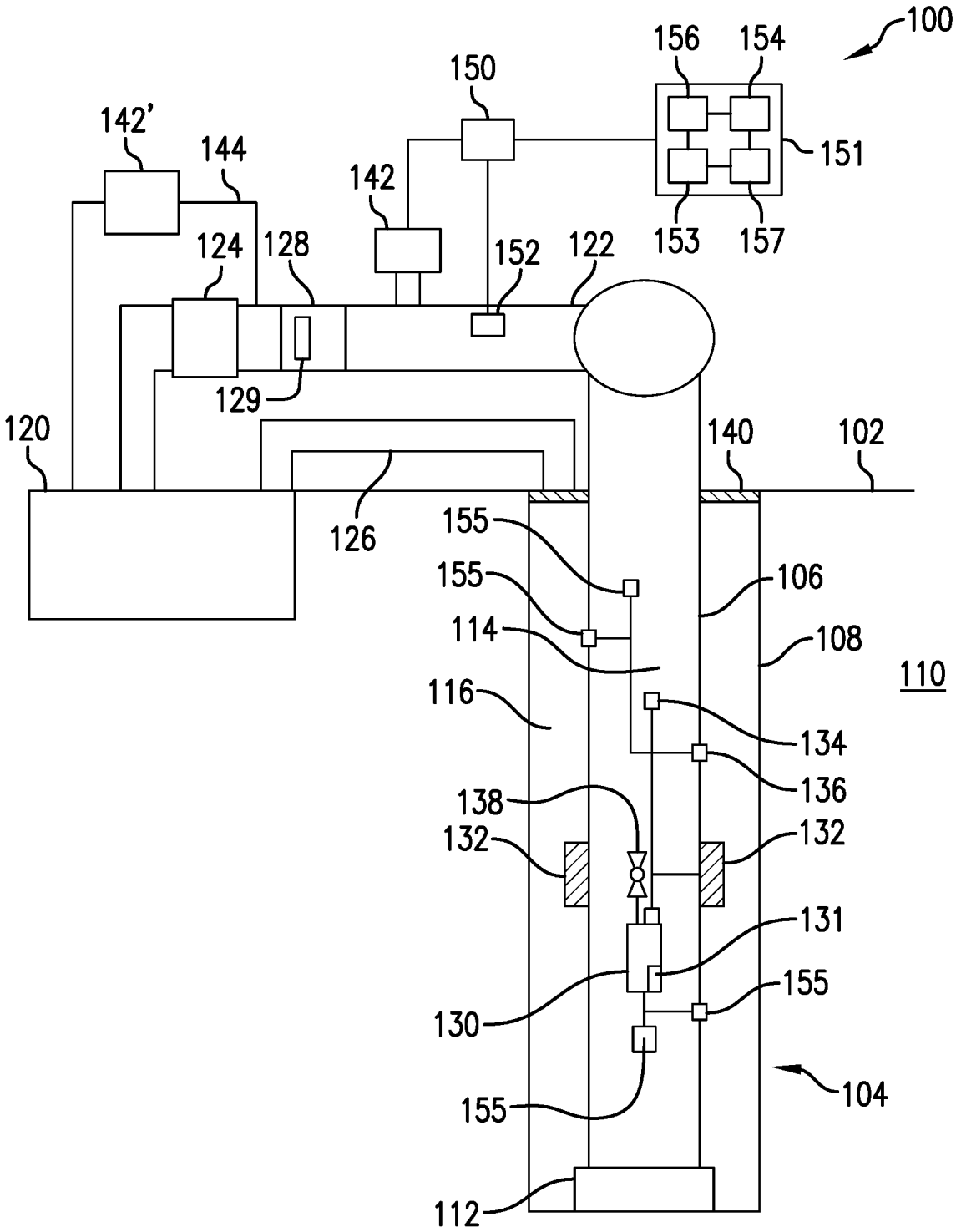
FIG. 1 shows an illustrative drilling system suitable for communicating data between a surface location and a downhole location.

Referring to FIG. 1, a downhole system 100 suitable for communicating information between a surface location 102 and a downhole location 104 is illustrated. The downhole system 100 may be a drilling system and includes a drill string 106 for drilling a wellbore or borehole 108 in an earth formation 110. The drill string 106 includes a drill bit 112 at an end thereof and defines an inner bore 114 through which a drilling mud can flow. The term mud or drilling mud is used herein to describe the fluid circulated through the drill string and the wellbore in order to clean the wellbore during the drilling process and to stabilize the wellbore after the drilling process. The drilling mud or fluid, also referred to as downhole fluid, downhole mud, or mud, also acts as coolant for the drill string. The lower part of the drill string includes a bottom hole assembly (BHA) which may include devices, herein also referred to as tools or downhole tools, for controlling the trajectory of the wellbore, such as a downhole motor or a steering device (e.g. rotary steerable). The BHA may further include measurement tools including a sensor 155 for measuring a parameter of the borehole, the BHA or the earth formation (formation evaluation tool/sensors), such as temperature (temperature sensor), pressure (pressure sensor), orientation of the BHA in the earth formation (e.g. magnetometer, gyro, accelerometer), formation resistivity (resistivity tool), formation acoustic parameters (acoustic tool), formation nuclear parameters (nuclear tool) or formation magnetic resonance (NMR) parameters (NMR tool). The measurement devices can be sensitive to either the outside of the BHA, such as the annulus and the earth formation, or the inner bore of the BHA, such as the fluid residing in the inner bore, or alternatively to both sides, outside and inside of the BHA. The BHA may also include sensors inside the tools in the BHA that collect data about the condition of the respective tool, like electronics or sensor health status (temperature, pressure, moisture, vibration, bending, and torsion). Further, the BHA may include a stabilizer to stabilize the BHA within the wellbore and/or a reaming device for enlarging the wellbore after the drilling process. In order to operate the different tools, the BHA may include electronics. The electronics may include a controller or a processor, a power supply, a battery, wires or cables, connectors or a memory. In alternative embodiments the downhole system may be a completion or well bore intervention system.

The drilling system 100 further includes a mud pit 120 at the surface location 102 having a drilling mud stored therein. A standpipe 122 serves as a conduit for flow of the drilling mud from the mud pit 120 to an entry of the drill string 106 at a top of the drill string 106.

During drilling, a mud pump 124 in the standpipe 122 pumps the drilling mud from the mud pit 120 through the standpipe 122 and into the drill string 106. The mud flows downhole through the inner bore 114 of the drill string 106 and exits the drill string 106 via the drill bit 112 at the bottom of the wellbore 108. The mud then flows upward to the surface through an annulus 116 between the drill string 106 and the formation 110 and returns to the mud pit 120 via a return line 126.

The standpipe 122 further includes an uphole mud pulser 128 for sending mud pulses downhole through the inner bore 114 of the drill string 106 while mud is flowing through the downhole system 100, usually referred to as a downlink. A pressure sensor 152, also referred to as pressure transducer, is configured to sense mud pulses being sent upward through the inner bore 114 of the drill string 106 by a downhole mud pulser (not shown), usually referred to as an uplink. In an alternate embodiment, a bypass actuator 142' (BAP) can be disposed in a bypass conduit 144 of the standpipe 122. The bypass conduit 144 extends from the mud pit 120 to a location downstream of the mud pump 124. The bypass actuator 142' bypasses a portion of the mud flow in the standpipe 122 and directs it to the mud pit 120, thereby modulating the pressure in the standpipe 122 thereby creating a flow pattern. A standpipe closing device 129, herein referred to as a shutter, disposed in the standpipe 122 can be used to close off the standpipe 122. In various embodiments, the shutter 129 can be a standalone device or part of the uphole mud pulser 128. The standpipe closing device 129 may be selected from alternative means to close a tube, such as all kinds of valves, feeders or sliders. Under flow-on conditions the flow pattern generated by the BAP 142' is detected by a communication tool in the BHA. The BHA communication tool includes a pulser module, such as a poppet valve pulser or a shear valve pulser. Additionally, the communication tool includes a power generation module which converts fluid flow energy in electrical energy. The power generation module includes a turbine and an alternator. The flowing fluid causes the turbine to spin. The turbine includes a guide wheel and a turbine wheel. The turbine wheel is coupled to a rotor of the alternator which supplies unregulated electrical power to a power regulation board. The output voltage is linear to the rotational speed (RPM) of the turbine wheel. While flow is turned on, the turbine wheel is used for downlink detection inside the wellbore. Changes in the flow pattern generate changes in the RPM pattern of the turbine wheel and generates the same pattern of output voltage. If the output voltage shows a predefined pattern, this pattern is recognized by the BHA communication tool. The pattern includes information (data and commands). The detected pattern is decoded and transmitted to a downhole controller inside the BHA, which performs an action based on the received information (e.g., update calibration data, transmit acquired data, shut down a downhole tool, open a valve, initiate an actuator, change drilling parameters, etc.).

The standpipe 122 further includes a pressure actuator 142 for generating pressure pulses in the mud in the standpipe 122 when mud is not flowing in the standpipe 122. The pressure actuator 142 can be hydraulic, pneumatic, electric, electro-hydraulic, piezoelectric, and electro-mechanical, in various embodiments. The pressure actuator 142 is a device configured to reduce or increase the cross area of the standpipe 122 and thereby reducing or increasing the fluid pressure in the standpipe. In one embodiment, the pressure actuator 142 includes a plunger or a piston inside a cylinder which is in direct fluid contact with the drilling mud of the standpipe 122. In another embodiment, the pressure actuator 142 may be a fluid pump that increases the fluid pressure. The fluid pump generates slow pressure variation corresponding to slow information rate (data rate). The pressure actuator 142 can increase a pressure (positive pressure pulse) or decrease a pressure (negative pressure pulse) in the standpipe 122 and therefore in the inner bore 114 of the drill string 106. The pressure actuator 142 can also generate a pressure pulse for propagation through the inner bore 114. In alternative embodiments the pressure actuator 142 may be located in the return line 126. In this alternate embodiment, the pressure pulse propagates through the annulus. An uphole controller 150 controls operation of the pressure actuator 142 in order to affect the pressure in the standpipe. The pressure sensor 152 measures pressure in the standpipe 122 and sends signals (e.g. electrical signal, optical signal, wireless signal) indicative of the measured pressure to the uphole controller 150. In various embodiments, the uphole controller 150 can perform an action in response to the measured pressure or a command or instructions encoded in a pressure signal detected at the pressure sensor 152. In an alternative embodiment the pressure signal may communicate downhole data, collected by downhole sensors, which allow evaluation of the downhole condition. The action performed by the uphole controller in response to the communicated downhole data may include processing downhole data, displaying downhole data, storing downhole data, initiating an action in response to the downhole data reaching a predefined value or crossing a threshold, initiating an alarm, or sending a signal (e.g., pressure pulse) downhole by activating the pressure actuator 142, the uphole mud pulser 128, or the bypass actuator 142'. Initiating an action may include, raising an alarm, operating a blow-out preventer, starting or stopping a mud pump, activating a DHIP, and/or operating the shutter (opening or closing). The uphole controller 151 may be part of or may be connected to a surface control unit 151. The surface control unit may be a computer-based system that processes the downhole data using a processor (uphole controller) 156 stored in a storage device (memory) 154 and provides information to an operator to take action or takes action by itself in accordance with programs and instructions 157 provided to the surface control unit 151. The surface control unit 151 displays desired operational parameters and other information on a display/monitor 153 utilized by an operator to control the downhole operation. The surface control unit 151 activates alarms when certain unsafe or undesirable operating conditions occur.

The downhole system 100 commonly includes a pressure compensator (not shown). The pressure compensator may be connected to the standpipe 122 of the downhole system 100. The pressure pulses generated by the pressure actuator 142 may be compensated by the pressure compensator. Closing the connection between standpipe 122 and pressure compensator or disconnecting the pressure compensator from the downhole system 100 will prevent unwanted dampening of pressure pulses that are intended to travel in the inner bore 114 either uphole or downhole at the speed of sound communicative of information to be transmitted from downhole to uphole locations or alternatively from uphole to downhole locations.

In various embodiments, the drill string 106 includes a closure device such as a blow-out preventer 140 at the surface location 102 that closes the wellbore 108 in response to a kick or an influx of gas into the wellbore 108 and shut down the mud pump immediately, thereby providing a flow-off situation in which no drilling mud is flowing. When the blow-out preventer 140 is activated, the flow of drilling mud is interrupted, leaving a standing or stationary volume or column of drilling mud within the inner bore 114 of the drill string and the annulus 116 beneath the blow-out preventer 140 and within a section of the standpipe 122. The drill string 106 further includes an annulus sealing element 132 (e.g., a packer) in the annulus 116 and an inner bore sealing element 138 (e.g., ball valve, a flapper), also referred herein to as a string valve. in the inner bore 114. The inner bore sealing element 138 is operated by an inner bore sealing element actuator. The annulus sealing element 132 is operated by an annulus sealing element actuator. Both the inner bore sealing element 138 and the annulus sealing element 132 may be a hydraulic, pneumatic, electric, electro-hydraulic, electro-mechanical, or piezoelectric device. The inner bore sealing element 138 can be activated an unlimited number of times. In various embodiments, the annulus sealing element 132 and the inner bore sealing element 138 are located at a same axial location of the drill string 106 at a selected depth of the borehole and are part of a same device. In alternate embodiments, the annulus sealing element 132 and the inner bore sealing element 138 are at different axial locations and are part of separate devices. The annulus sealing element and the inner bore sealing element may be located in the same downhole tool (module) in the BHA or may be located in different downhole tools in the BHA. The annulus sealing element and the inner bore sealing element may be part of a downhole isolation packer (DHIP). The axial location of the drill string 106 is referring to the longitudinal axis of the drill string.

A downhole isolation packer (DHIP) is used to stop hydrocarbons originating from the earth formation that are entering the wellbore due to a higher pressure in the earth formation than in the wellbore (a kick). The DHIP can stop the kick from propagating further uphole along the wellbore to the surface. The main propagation path of the kick is the annulus 116. A wellbore usually includes a blow-out-preventer (BOP) 140 that would be activated as soon as hydrocarbon concentration or $H_2S$ concentration in the circulating drilling fluid reaches a predefined concentration. Hydrocarbons may be in the drilling fluid in gaseous phase or in liquid phase. After detection of the kick the BOP is closed in order to close the annulus between the drill string and the borehole wall. The BOP is located at the surface and prevent the kick from leaving the wellbore. The fluidal connection between the inner bore 114 of the string 106 and the standpipe (SP) 122 remains open. Only when the shear ramps of the BOP are activated is the fluidal connection between inner bore 114 and the SP 122 interrupted also. Under BOP closed conditions, circulation of drilling fluid is no longer possible and a downlink sent from surface cannot be detected by RPM variations of the turbine wheel. In order to shut down the well and to stop the kick at a location that is closer to where the kick is happening it is beneficial to deploy a downhole isolation packer. The DHIP includes an inner bore sealing element and an annulus sealing element. Both may be operated independently of each other to seal off either the inner bore or the annulus or both. Wired pipe communication can be used to activate the DHIP when a kick is detected and the BOP is activated. If wired pipe communication isn't available alternative communication means are required to communicate between surface and DHIP. The BOP only closes the annulus 116. The fluidal connection between the SP 122 and the inner bore 114 of the drill string 106 remains open although no circulation is possible anymore. The fluidal connection between the SP 122 and the inner bore 114 allows flow-off downlink telemetry from the surface location to a downhole location (e.g. a DHIP) and flow-off uplink telemetry from a downhole location (e.g. a DHIP) and a surface location. Flow-off mud pulse telemetry may be used to communicate instructions (information) from a surface location to the DHIP in the wellbore. In the operation of the DHIP, the mud pulse telemetry can be used during a flow-off status. Without the flow-off telemetry neither the control commands from surface to the DHIP in the wellbore can be transmitted nor the confirmation from the DHIP and downhole data acquired by downhole sensors in the wellbore to the surface location can be transmitted. The DHIP may be run above, below or in the BHA and consists of four main modules, one each for the main functions: an inner bore module to seal the inner bore of the string, a packer module to seal the annulus between the string and the wellbore wall, and a bypass module to open a bypass to enable circulation above the sealing elements. The DHIP may also consist of auxiliary modules such as a DHIP communication module and a battery module. Each module may have an integral stabilizer. The downhole device that performs transmission and reception of the flow-off telemetry is the DHIP communication module.

When a kick is detected at the surface, the BOP is activated by the uphole controller which sends the activation command to the BOP. The detection may happen by monitoring downhole data transmitted by mud pulse telemetry to the surface. The BOP closes the annulus. The mud pumps are stopped by another controller command. In a next step the uphole controller controls the pressure actuator 142 to create at least one pressure pulse at the surface location inside the standpipe to activate the DHIP. The pressure pulse propagates through the fluid inside the standpipe and inside the inner bore of the drill string while the mud flow is off. The pressure pulse is detected by a pressure sensor at a downhole location inside the BHA or the DHIP. A downhole controller receives the signal which is generated based on the pressure reading of the pressure sensor and provides a control signal to activate the annular sealing element and/or the inner bore sealing element. It is understood that all control actions performed in an automated fashion by the uphole controller 150 may alternatively performed by an operator by giving manual controls (pressing a button, typing a command).

A downhole string with a DHIP incorporated may include a bypass valve 136 allowing fluid communication between the inner bore and the annulus. The bypass valve 136 is operated by a bypass valve actuator which may be hydraulic, pneumatic, electric, electro-hydraulic, electro-mechanical, or piezoelectric. The bypass valve 136 can be activated an unlimited number of times. A number of ports (e.g. 4, 6, 8 or 10 ports) on the circumference of the bypass module ensure a sufficient flow area for a bypass flowrate up to 3000 liters per minute. The bypass valve 136 can be opened independently from the annulus sealing element 132 or inner bore sealing element 138 and can be used as a circulation valve to improve hole cleaning. The bypass valve 136 is located above the annulus sealing element 132 and the inner sealing element 138 and is utilized to circulate drilling fluid from the inner bore 114 to the annulus 116 in case the DHIP is activated (i.e., inner bore sealing element 138 closed or annulus sealing element closed 132). The circulation through the bypass valve 36 allows circulating out any current formation fluid influx and allows increasing the mud weight above the annulus sealing element 132 and inner bore sealing element 138. The bypass valve 136 may alternatively be used to replace the drilling fluid in the upper portion (uphole the DHIP) of the wellbore for a drilling fluid which is suited to treat the kick. Once the drilling fluid is replaced or the kick is circulated out the DHIP may be deactivated (i.e., bypass valve 136 closed, inner bore sealing element opened and/or annulus sealing element opened) by an exit or deactivation downlink. The drilling fluid now can penetrate the lower portion of the wellbore (downhole of the DHIP) in order to stop the kick and to heal the kick. As a consequence, reestablishment of drilling fluid circulation through the whole wellbore can be eventually achieved. In case there is no BOP or the BOP isn't activated after the detection of a kick, circulation of drilling fluid is not interrupted and regular flow-on telemetry can be used to activate the DHIP. With the activation, circulation of the drilling fluid is interrupted, thereby preventing flow-on telemetry. In both cases, with and without a BOP activation flow-off communication from a downhole location to a surface location is possible by using the bypass valve 136 and a differential pressure between the inner bore pressure and the annulus pressure for creating uplinks.

A downhole controller 130 is located on the drill string 106 for operating various devices downhole. The downhole controller 130 can operate using energy generated by mud flow or can include a power supply 131 that allows the downhole controller 130 to operate in the absence of mud flow. In various embodiments, the power supply 131 can be a battery (e.g. a lithium battery), a capacitor, a capacitor bank or a fuel cell. The battery may also be used to provide energy to the bypass valve actuator, to a memory in the DHIP, to the inner bore sealing element actuator, or the annulus sealing element actuator. The battery may by located in a battery module or may be included in another downhole tool in the BHA or in another module of the DHIP. The battery is configured to provide power in flow-off conditions or low flow conditions when the energy provided by the power generator in the BHA or DHIP is not sufficient to power the BHA or DHIP. A diode integrated in the DHIP ensures only the DHIP modules are powered. The remaining BHA components below or above the DHIP, such as the measurement-while-drilling (MWD) or rotary steerable system (RSS) are electrically disconnected to save battery life. In various embodiments, the downhole controller 130 can expand the annulus sealing element 132 and the inner bore sealing element 138 either on its own (automated) based on downhole sensor readings or in response to a pressure signal sent downhole to the downhole controller 130. A pressure sensor 134 is disposed in the inner bore 114 of the drill string 106 at the downhole location 104. The pressure sensor 134 can be part of a mud pulser (not shown) of a mud telemetry system in various embodiments, e.g. the communication module of the DHIP or the communication tool of the BHA. The pressure sensor 134 located in the inner bore of the drill string 106 senses pressure variations (pressure pulse, pressure signal) in the inner bore 114 also when the flow is off and sends a signal to the downhole controller 130 indicative of the sensed pressure variation. The pressure variation (pressure signal) may be sent by the pressure actuator 142. The drill string 106 further includes a bypass valve 136 at the downhole location 104. The bypass valve 136 can be opened to provide a passage for fluid communication between the inner bore 114 and the annulus 116 or closed to isolate the inner bore 114 from the annulus 116. The bypass valve 136 and the pressure sensor 134 are located above (uphole of) the inner bore sealing element 138 in order to be in fluid communication with the pressure actuator 142 and pressure sensor 152 when the inner bore sealing element 138 has been activated. Alternatively, the bypass valve 136 and the pressure sensor 134 are located uphole of the inner bore sealing element 138 and the annulus sealing element 132. The pressure sensor 134 may be located in the inner bore 114 or in the annulus 116 depending on which column of fluid is used by the propagation pressure signal. Various additional sensors 155 can be located below (downhole of) or above (uphole of) the inner bore sealing element in the inner bore 114 or the annulus 116 to obtain data downhole. Alternatively, additional sensors 155 can be located in the annulus 116 uphole or downhole of the annulus sealing element 132. In various embodiments, the additional sensors 155 can be pressure sensors, temperature sensors, formation evaluation sensors, chemical analysis sensors, etc.

The annulus sealing element 132 includes an inflatable packer element to seal off the annulus 116. The packer element is inflated by standpipe pressure, requiring no circulation. While drilling, the packer element is stored behind a protection sleeve that protects the packer element from wall contact and pre-mature damage. When the inner bore is sealed by the inner bore sealing element the DHIP communication module confirms the sealed off inner bore by flow-off telemetry. In response the standpipe pressure is increased. As soon as a required standpipe pressure is reached a sleeve valve is opened by the downhole controller 130 and connects the inner bore 114 of the string 106 with the sleeve actuator. The sleeve actuator may receive energy from the battery. The sleeve is retracted by differential pressure (between annulus 116 and inner bore 114). In a subsequent step a packer valve opens and connects the packer to the inner bore 114 using the differential pressure (between annulus 116 and inner bore 114) to inflate the packer element. Once inflated, the pressure inside the packer element is compared to the annular pressure above and below the packer. If the differential pressure drops below a defined threshold, a booster pump is automatically activated to refill the packer and bring the differential pressure back to a desired target value to maintain the sealing capability. In embodiments the sleeve valve and the packer valve may be only one valve. After the kick is killed and the wellbore is under control, a deactivation downlink is sent to the communication module of the DHIP. In response to the deactivation downlink the downhole controller connects the packer valve to the annulus 116 for deflation. The controller also opens the string valve. Circulation can be restarted.

In order to send a signal downhole during a flow-off situation, the shutter 129 is closed to create a region of mud between the shutter 129 and the blow-out preventer 140 via the inner bore 114 of the drill string and the annulus 116. In various embodiments, the pressure actuator 142 sends a command in the form of a pressure pulse or pressure signal through the inner bore 114. The pressure sensor 134 senses the pressure pulse and sends a signal related to the pressure pulse to the downhole controller 130. In response, the downhole controller 130 performs an action downhole, such as closing the inner bore sealing element 138 or expanding the annulus sealing element 132 or opening the bypass valve 136 or all together. Closing the inner bore sealing element 138 and expanding the annulus sealing element 132 creates three sealed regions of mud, as described below with respect to FIG. 2. Pressure signals sent downhole can also include information or commands to inflate/deflate a packer, close/open a valve sleeve valve, packer valve, string valve, bypass valve, initiate measurements, or communicate calibration data, etc. In alternative embodiments the annulus sealing element 132 and/or the inner bore sealing element 138 can be activated (expended, closed) without the blow-out preventer 140 being closed. The pressure pattern (signals) sent by pressure pulses created either by the pressure actuator 142 (downlink) or by the bypass valve 136 (uplink) may be a single pressure pulse communicating an acknowledgement of an operational condition, a wellbore condition, or an initiation or conclusion of an action (e.g. annulus sealing element or inner bore sealing element closed). Alternatively, the communicated information may be encoded in a series of pressure pulses. The series of pressure pulses may include high level data encoding (Frequency Shift Key (FSK), Phase Shift Key (PSK), Amplitude Modulation (AM, pulse duration, quiet periods)) and may utilize data compression, error detection/correction methods (automatic repeat request, forward error correction, checksum, parity bit, cyclic redundancy check). The series of pressure pulses may contain pressure pulses representing a certain number of bits in a binary code (e.g. 1, 2, 3, 4, 5, 8, 12 or more bits). There may be a start bit, or start bit sequence indicating the binary code to be transmitted by the pressure pulses and a stop bit, or stop bit sequence indicating the completion of the binary code transmitted by the pressure pulses.

Figure 2:
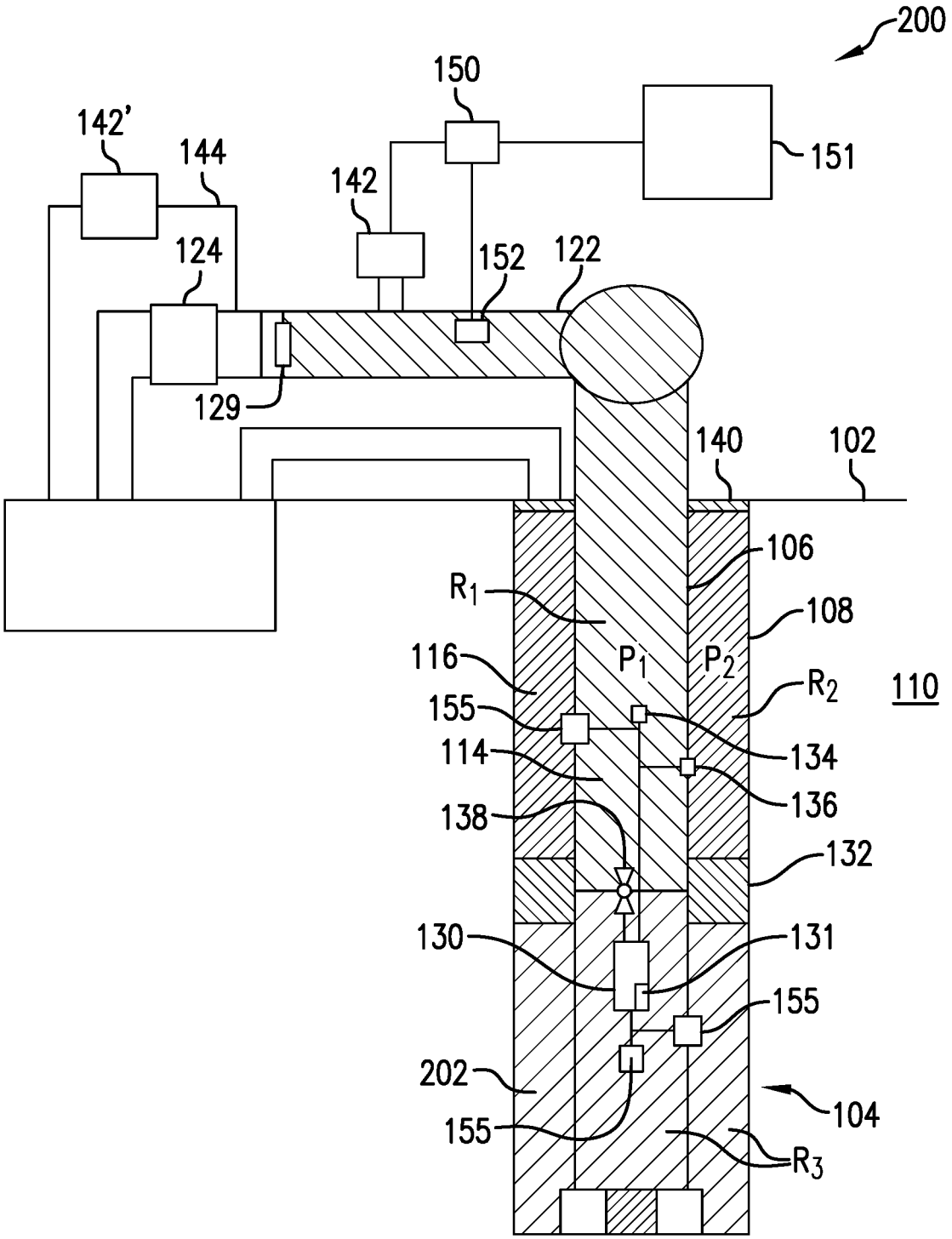
FIG. 2 illustrates an operation for communicating m a downhole location to a surface location after closure of the drill string.

FIG. 2 illustrates an operation for communicating from a downhole location to a surface location after closure of the drill string 106. The configuration of FIG. 2 is a result of a pressure signal (command) sent downhole from the pressure actuator 142 'flow-off) or bypass actuator 142'(flow-on), as discussed above with respect to FIG. 1. Three sealed regions of mud are formed by closure of the blow out preventer 140, the inner bore sealing element 138 and the expansion of the annulus sealing element 132. A first region $R_1$ includes a first standing fluid column in the inner bore 114 and standpipe 122 between the closed shutter 129 and the inner bore sealing element 138. A second region $R_2$ includes a second standing fluid column in the annulus 116 between the annulus sealing element 132 and the blow-out preventer 140. A third region $R_3$ includes a third fluid column in the inner bore 114 below the inner bore sealing element 138 and the annulus 116 below the annulus sealing element 132. The third column includes a first portion of the third column in the inner bore 114 and a second portion of the third column in the annulus below the annulus sealing element 132. The first portion and the second portion of the third column are in fluid communication through the drill bit.

In order to generate pulses in region $R_1$ at the downhole location, bypass valve 136 is closed (if not already closed) and the pressure actuator 142 is activated to increase a pressure in region $R_1$. In the standpipe 122, either the shutter 129 is closed or mud pump 124 and bypass actuator 142' are in a fluid flow blocking position. As a result, the pressure $P_1$ in the first region $R_1$ is increased to be greater than the pressure $P_2$ in the second region $R_2$. Once the pressure differential has been established, the downhole controller 130 opens and closes the bypass valve 136 between first region $R_1$ and second region $R_2$ to produce a pulse or a sequence of pulses due to the pressure differential. Opening and closing the bypass valve fluidly couples the first region $R_1$ and the second region $R_2$. The pulse or sequence of pulses is a negative pulse (pressure is lowered by opening bypass valve 136) in first region $R_1$ due to the pressure differential between first region $R_1$ and second region $R_2$. The pulse or sequence of pulses propagates uphole in the first region $R_1$ through the inner bore 114. The bypass valve 136 can be opened and closed in a timed sequence in order to send, in the form of pressure pulses, a coded signal to the surface location 102 that is decoded at the surface by the uphole controller 150 after the pressure pulses detected by pressure sensor 152 have been transmitted to uphole controller 150. In one embodiment, the coded signal includes pressure readings from a pressure sensor below the inner bore sealing element 138. In another embodiment, the coded signal includes an information which leads to an initiation of an operation at the surface location (e.g. changing the downhole fluid, opening or closing the BOP, start pumps). In addition, the coded signal can include data from a downhole location for use at the surface location 102. Data sent from downhole to the surface can include, but is not limited to a temperature measurement, a pressure measurement, formation evaluation measurements (such as acoustic measurements, NMR measurements, nuclear measurements, resistivity measurements, sampling measurements, etc.) and/or data from a chemical analysis sensor that identifies formation gases and/or formation fluids involved in the kick.

It is to be understood that after activating the inner bore sealing element 138 and the annulus sealing element 132, there may exist a natural differential pressure between first and second regions $R_1$ and $R_2$. In various embodiments, the natural differential pressure between first and second region $R_1$ and $R_2$ can be used for the pulse generation via valve 136.

In embodiments, the bypass valve 136 may be split in two separate bypass valves. A first bypass valve, also referred to as a pulse bypass valve, is used to create the pressure pulses downhole by using the differential pressure between the first region $R_1$ and the second region $R_2$. The pulse bypass valve may be configured to generate pressure pulses based on a specific differential pressure regime, such as a small differential pressure of only a few bars (such as 1 to 10, 1 to 7, 1 to 4, 1 to 3 bar, 1 to 2 bar) or a medium differential pressure (such as 10 to 30, 10 to 20 bar) or a large differential pressure (such as 20 to 50, 20 to 30, 20 to 40 bars). A second bypass valve, also referred to as a circulation bypass valve, may be optimized to bypass amounts of fluid in order to circulate a kick out, or to replace a drilling fluid. In alternative flow-off telemetry embodiments without the deployment of a DHIP, the circulation bypass valve may not be in the downhole string at all and a separate pulse bypass valve is required for using the differential pressure between inner bore and the annulus.

Over time, as the bypass valve 136 is operated to create pulses, the pressure differential between the first region $R_1$ and the second region $R_2$ decreases, thereby decreasing the pressure amplitude of the pulses generated by the bypass valve 136. If deemed necessary, the valve 136 can be closed again and the pressure actuator 142 at the surface can be used to reestablish the pressure differential between first region $R_1$ and second region $R_2$. To observe the pressure inside the inner bore in first region $R_1$ or the annulus pressure in second region $R_2$, an inner bore pressure sensor and/or an annulus pressure sensor may be located in the BHA configured to watch the differential pressure between the inner bore in the first region $R_1$ and the annulus in the second region $R_2$. The annulus pressure sensor and the inner bore pressure sensor are located uphole to the inner bore sealing element and uphole the annulus sealing element, respectively. The inner bore pressure sensor may coincide with the pressure sensor 134. The differential pressure, the bore pressure or the annulus pressure may be used to control the bypass valve 136 or may be sent to surface by the coded pressure signal created by opening and closing the bypass valve 136. The differential pressure, the inner bore pressure or the annulus pressure may be saved to a memory in the BHA for being sent to and/or processed at the surface location 102 after the downhole operation. The differential pressure, the inner bore pressure or the annulus pressure may be used to adjust the operation of the bypass valve 136 in order to optimize the generation of the pressure pulses. An operational parameter for the bypass valve 136 that may be adjusted based on the differential pressure, the bore pressure or the annulus pressure may be the length of the pressure pulses (the time that the bypass valve 136 opens and/or closes for the generation of a pressure pulse), or a cross-sectional area of the passage for the fluid communication that the bypass valve 136 allows, or a number of pressure pulses per time interval. The differential pressure, the bore pressure or the annulus pressure may be communicated by the inner bore pressure sensor 134 or the annulus pressure sensor 155 to the downhole controller 130. The adjustment of the operational parameters of the bypass valve 136 may be performed real time, while the drill string 106 is downhole in the flow-off situation. The adjustment may be performed fully automated without interference of a human being. The pressure pulses generated by the bypass valve 136 have data rate between 1 and 2 pulses per second, 1 and 4 pulses per second, 1 and 6 pulses per second or 1 and 12 pulses per second. In alternative embodiments the pressure pulses may be generated downhole using a downhole pressure actuator. The downhole pressure actuator may be powered by a downhole battery.

The pressure actuator may include a pulse pressure actuator configured to generate pressure pulses and a differential pressure actuator configured to increase the pressure in the standpipe and the inner bore, respectively. Increasing the pressure in the inner bore will result in an increased differential pressure between inner bore and annulus. In alternative embodiments only one pressure actuator in the standpipe will provide pressure pulses and sufficient inner bore pressure.

It is to be understood that when the inner bore sealing element 138 has been activated, there can still be full electrical communication along the BHA, including the DHIP, because the downhole tools are connected with a modular connection allowing transfer of electrical communication and power lines. Thus, the downhole controller 130, sensors 155, power supply 131 are all operable below the inner bore sealing element 138. The electrical communication may be performed through the collar of the BHA, which may contain the electronics, sensor, valve, or battery. Alternatively, electronics, sensor, valve or battery may be located in a probe in the inner bore or located in a wall of the inner bore in the BHA (collar of a downhole tool).

Downhole pressure above and below the annular sealing element (packer) and inside the inner bore below and above the string valve can be monitored by sensors 155 and communicated in real time by using the bypass valve 136. The tool status and the pressure readings of the annulus above and below the packer element, inside the packer element and inside the inner bore are transmitted via flow-off telemetry to surface. The real-time information can be monitored on a customized display. Data transmitted via flow-off telemetry from the downhole location to the surface location may be one of pressure readings in the inner bore below and above the string valve, pressure readings in the annulus below and above the packer, differential pressure in the inner bore between below and above the string valve, differential pressure in the annulus below and above the packer, differential pressure between the inner string and the annulus below and above the string valve and below and above the packer, gas sensor readings below and above the string valve, gas sensor readings below and above the packer, temperature sensor readings below and above the string valve, temperature sensor readings below and above the packer, formation evaluation (FE) data readings below and above the packer. Pressure reading inside the annular sealing element (packer). The gas sensor may be configured to detect hydrocarbon or $H_2S$ gas. FE data may be gamma ray data, resistivity data, acoustic data, formation sampling data, nuclear magnetic resonance (NMR) data, and nuclear data. The sensor used to monitor the mentioned information are sensors 155 representing various downhole sensors as pressure, temperature, gas, FE sensors.

Figure 3:
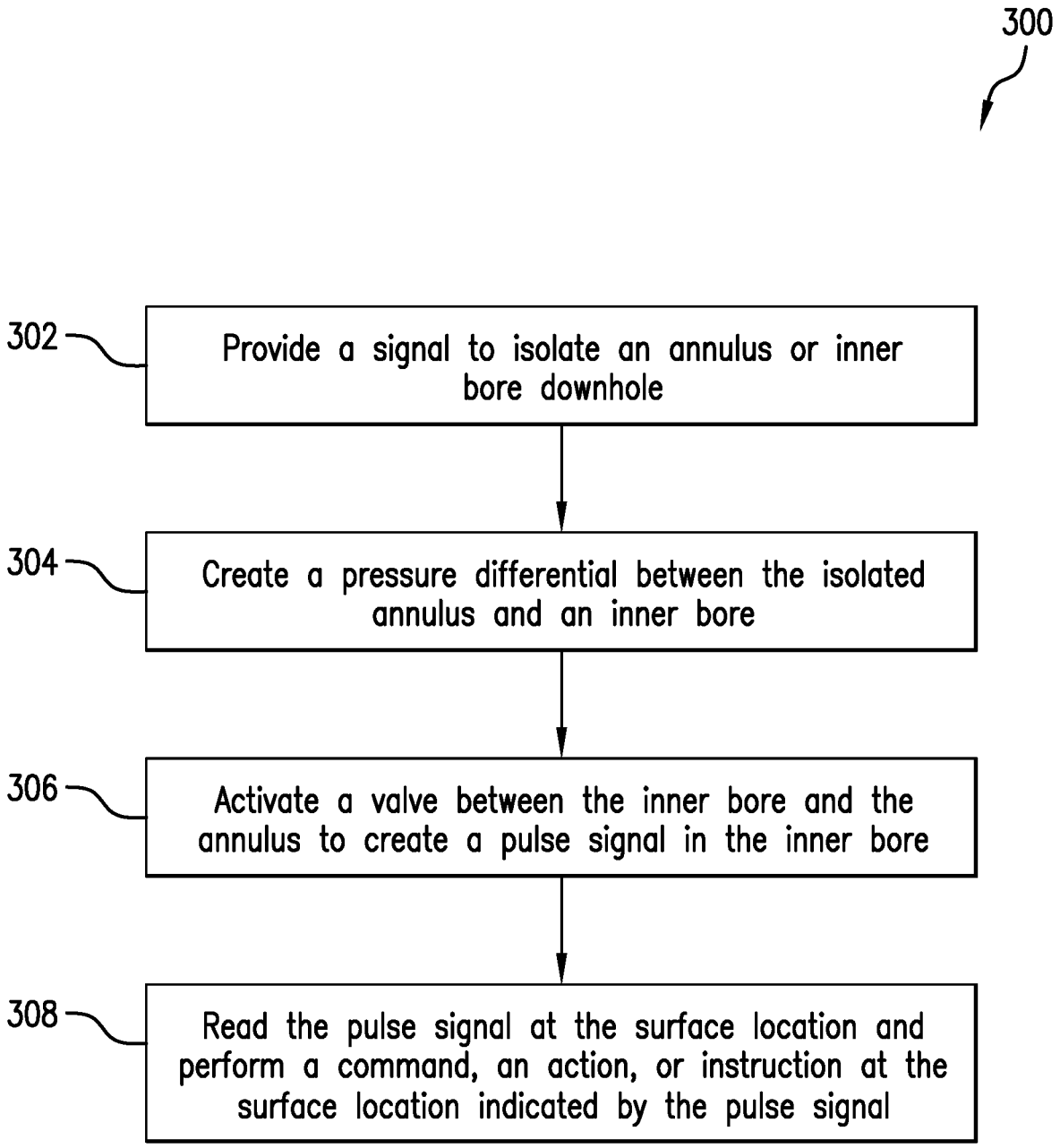
FIG. 3 shows a flowchart illustrating a method for communicating between a downhole location and an uphole location in a situation with no mud flow in the drill string.

FIG. 3 shows a flowchart 300 illustrating a method for communicating between a downhole location and an uphole location in a situation with no mud flow in the drill string and wellbore. In box 302, a pressure signal is provided downhole to isolate regions $R_1$ and $R_2$ downhole. The signal can include one or more of expanding the annulus sealing element 132, closing the inner bore sealing element 138 and closing valve 136. In box 304, a pressure differential is created between region $R_1$ and region $R_2$. In box 306, the valve 136 is activated in order to create a pulse in region $R_1$ due to the created pressure difference between the inner bore 114 and the sealed region $R_2$. In box 308, the pulse is read at a surface location and an action or command or instructions indicated by the pulse is performed at the surface location.

Set forth below are some embodiments of the foregoing disclosure:

Embodiment 1: A method of communicating information from a downhole location in a borehole to a surface location while fluid circulation is off. A string of a downhole system is conveyed in the wellbore, the string defining an inner bore and an annulus. A first standing column of fluid is created in the inner bore and a second standing column of fluid is created in the annulus by closing at least one of the inner bore using an inner bore sealing element and the annulus using an annulus sealing element during a flow off condition. A bypass valve at a first location in the string is activated to generate a pressure pulse due to a pressure difference between the first standing column of fluid and the second standing column of fluid, wherein the generated pulse is communicative of information. The pressure pulse is received at a pressure sensor at the surface location of the downhole system. A controller performs the action in response to the information in the pressure pulse.

Embodiment 2: The method of any prior embodiment, wherein using the annulus sealing element comprises expanding a packer to close the annulus.

Embodiment 3: The method of any prior embodiment, wherein the pressure pulse is generated in the inner bore and the pressure pulse is a negative pressure pulse.

Embodiment 4: The method of any prior embodiment, wherein activating the bypass valve includes opening the bypass valve to fluidly couple the first standing column of fluid to the second standing column of fluid.

Embodiment 5: The method of any prior embodiment, wherein the bypass valve is located uphole of the annulus sealing element.

Embodiment 6: The method of any prior embodiment, wherein the bypass valve comprises a first bypass valve and a second bypass valve, further comprising using the first bypass valve for generating pressure pulses communicative of information and using the second bypass valve for circulating fluid from one of the inner bore to the annulus and the annulus to the inner bore.

Embodiment 7: The method of any prior embodiment, further comprising creating the pressure difference by making a pressure in the first standing column of fluid greater than a pressure in the second standing column of fluid using a pressure actuator.

Embodiment 8: The method of any prior embodiment, further comprising using a controller to activate the bypass valve.

Embodiment 9. The method of any prior embodiment, wherein the action comprises one of raising an alarm, operating a blow-out preventer, starting or stopping a pump, storing the information, processing the information, transmitting another information to the downhole location.

Embodiment 10. The method of any prior embodiment, wherein activating the bypass valve comprises using a battery to provide energy to a bypass valve actuator.

Embodiment 11. The method of any prior embodiment, further comprising measuring a first pressure by a first downhole pressure sensor in the inner bore and measuring a second pressure by a second downhole pressure sensor in the annulus, wherein the information communicated with the pressure pulse comprises at least one of the first pressure, the second pressure and a differential pressure.

Embodiment 12. The method of any prior embodiment, wherein measuring the first pressure uphole of the inner bore sealing element and measuring the second pressure uphole of the annulus sealing element.

Embodiment 13: A flow-off telemetry system in a wellbore, the system including a string in the wellbore, the string defining an inner bore of the string and an annulus between the string and a wall of the wellbore; at least one of an inner bore sealing element configured to close the inner bore to create a first standing column of fluid in the inner bore and an annulus sealing element configured to close the annulus to form a second standing column of fluid in the annulus; a bypass valve in the string at a downhole location between the first standing column of fluid and the second standing column of fluid, wherein activation of the bypass valve generates a pressure pulse including information for performing an action; a sensor at a surface location receptive to the pressure pulse; and a controller configured to perform an action in response to the information in the pressure pulse.

Embodiment 14: The wellbore system of any prior embodiment, wherein the annulus sealing element further comprises a packer expandable to close the annulus.

Embodiment 15. The wellbore system of any prior embodiment, wherein the bypass valve generates the pressure pulse as a negative pressure pulse in the inner bore.

Embodiment 16: The wellbore system of any prior embodiment, wherein the bypass valve fluidly couples the first standing column of fluid to the second standing column of fluid.

Embodiment 17: The wellbore system of any prior embodiment, wherein the bypass valve further comprises a first bypass valve for generating pressure pulses to communicate the information and a second bypass valve for circulating fluid one of the inner bore to the annulus and the annulus to the inner bore.

Embodiment 18: The wellbore system of any prior embodiment, wherein the action comprises one of raising an alarm, operating a blow-out preventer, starting or stopping a pump, storing the information, processing the information, transmitting another information to the downhole location.

Embodiment 19: The wellbore system of any prior embodiment, further comprising a first downhole pressure sensor in the inner bore for measuring a first pressure and a second downhole pressure sensor in the annulus for measuring a second pressure, wherein the information communicated with the pressure pulse comprises at least one of the first pressure, the second pressure and a differential pressure.

Embodiment 20: The wellbore system of any prior embodiment, wherein the first downhole pressure sensor is uphole of the inner bore sealing element and the second downhole pressure sensor is uphole of the annulus sealing element.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

It is understood that the term "above" as used herein refers to being closer to a surface location and the term "below" refers to being further away from a surface location. Thus, an element A that is "above" element B is closer to the surface than element B and an element C that is "below" of element B is further from the surface then element B. Similarly, an element A that is "uphole" of element B is closer to the surface than element B and an element C that is "downhole" of element B is further from the surface then element B. The term surface location in this disclosure refers to a location outside the wellbore and at or above the surface of the earth.

The teachings of the present disclosure may be used in a variety of well operations. These operations may involve using with the drilling mud or fluid one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds or fluids, such as water based, oil based or synthetic muds. The drilling mud or fluid may comprise emulsifiers, demulsifiers, defoamers, tracers, flow improvers, weighting agents, such as Bentonite, loss circulation material, gelling agents or viscosifiers, lubricants, various polymers, or salts, or minerals, or chemicals to control the PH-value of the drilling mud or fluid. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of communicating information from a downhole location in a borehole to a surface location while fluid circulation is off, the method comprising:

conveying a string of a downhole system in the borehole, the string defining an inner bore and an annulus;

creating a first standing column of fluid in the inner bore and a second standing column of fluid in the annulus by closing at least one of the inner bore using an inner bore sealing element and the annulus using an annulus sealing element during a flow-off condition;

activating a bypass valve in the string at the downhole location to generate a pressure pulse due to a pressure difference between the first standing column of fluid and the second standing column of fluid, wherein the generated pressure pulse is communicative of information;

receiving the pressure pulse at a pressure sensor at the surface location; and performing, using a controller, an action in response to the information communicated by the pressure pulse.

2. The method of claim 1, wherein using the annulus sealing element comprises expanding a packer to close the annulus.

3. The method of claim 1, wherein the pressure pulse is generated in the inner bore and the pressure pulse is a negative pressure pulse.

4. The method of claim 1, wherein activating the bypass valve includes opening the bypass valve to fluidly couple the first standing column of fluid to the second standing column of fluid.

5. The method of claim 1, wherein the bypass valve is located uphole of the annulus sealing element.

6. The method of claim 1, wherein the bypass valve comprises a first bypass valve and a second bypass valve, further comprising using the first bypass valve for generating the pressure pulse communicative of the information and using the second bypass valve for circulating fluid from one of the inner bore to the annulus and the annulus to the inner bore.

7. The method of claim 1, further comprising creating the pressure difference by making a pressure in the first standing column of fluid greater than a pressure in the second standing column of fluid using a pressure actuator.

8. The method of claim 1, further comprising using a controller to activate the bypass valve.

9. The method of claim 1, wherein the action comprises one of raising an alarm, operating a blow-out preventer, starting or stopping a pump, storing the information communicated with the pressure pulse, processing the information communicated with the pressure pulse, and transmitting another information to a location in the borehole.

10. The method of claim 1, wherein activating the bypass valve comprises using a battery to provide energy to a bypass valve actuator.

11. The method of claim 1, further comprising measuring a first pressure by a first downhole pressure sensor in the inner bore and measuring a second pressure by a second downhole pressure sensor in the annulus, wherein the information communicated with the pressure pulse comprises at least one of the first pressure, the second pressure, and a differential pressure.

12. The method of claim 11, further comprising measuring the first pressure uphole of the inner bore sealing element and measuring the second pressure uphole of the annulus sealing element.

13. A flow-off telemetry system in a borehole, comprising:

a string in the borehole, the string defining an inner bore of the string and an annulus between the string and a wall of the borehole;

at least one of an inner bore sealing element configured to close the inner bore to create a first standing column of fluid in the inner bore and an annulus sealing element configured to close the annulus to create a second standing column of fluid in the annulus;

a bypass valve in the string at a downhole location between the first standing column of fluid and the second standing column of fluid, wherein activation of the bypass valve generates a pressure pulse including information for performing an action;

a sensor at a surface location receptive to the pressure pulse; and a controller configured to perform the action in response to the information included in the pressure pulse.

14. The flow-off telemetry system of claim 13, wherein the annulus sealing element further comprises a packer expandable to close the annulus.

15. The flow-off telemetry system of claim 13, wherein the bypass valve generates the pressure pulse as a negative pressure pulse in the inner bore.

16. The flow-off telemetry system of claim 13, wherein the bypass valve fluidly couples the first standing column of fluid to the second standing column of fluid when open.

17. The flow-off telemetry system of claim 13, wherein the bypass valve further comprises a first bypass valve for generating the pressure pulse including the information and a second bypass valve for circulating fluid from one of the inner bore to the annulus and the annulus to the inner bore.

18. The flow-off telemetry system of claim 13, wherein the action comprises one of raising an alarm, operating a blow-out preventer, starting or stopping a pump, storing the information included in the pressure pulse, processing the information included in the pressure pulse, and transmitting another information to a location downhole.

19. The flow-off telemetry system of claim 13, further comprising a first downhole pressure sensor in the inner bore for measuring a first pressure and a second downhole pressure sensor in the annulus for measuring a second pressure, wherein the information included in the pressure pulse comprises at least one of the first pressure, the second pressure, and a differential pressure.

20. The flow-off telemetry system of claim 19, wherein the first downhole pressure sensor is uphole of the inner bore sealing element and the second downhole pressure sensor is uphole of the annulus sealing element.

* * * * *